United States Patent [19]

Sinclair

[11] Patent Number: 4,564,253

[45] Date of Patent: Jan. 14, 1986

[54] CRIMP-ON CONNECTOR FOR FLAT CABLE

[75] Inventor: William Y. Sinclair, Stockton, N.J.

[73] Assignee: Aries Electronics, Inc., Frenchtown, N.J.

[21] Appl. No.: 680,544

[22] Filed: Dec. 11, 1984

[51] Int. Cl.[4] ..... H01R 4/24

[52] U.S. Cl. ..... 339/97 C

[58] Field of Search ..... 339/97 R, 97 C, 97 P, 339/98, 99 R, 276 R, 276 T

[56] References Cited

U.S. PATENT DOCUMENTS 4,371,225 2/1984 Narozny ..... 339/97 C 4,458,969 7/1984 Demeo ..... 339/97 C

*Primary Examiner*—Joseph H. McGlynn

*Attorney, Agent, or Firm*—Anthony J. Casella; Gerald E. Hespos

[57] ABSTRACT

Crimp-on connectors and housing are provided for a flat cable. The connectors may define either sockets or plugs. Each connector includes a cable mounting end affixed to a carrier strip. The cable mounting end has barbs for piercing the cable and a lance for aligning the cable. A contact end of each connector enables secure mounting of the connector in the housing. The housing is adapted to receive either a socket or plug connector.

19 Claims, 11 Drawing Figures

CRIMP-ON CONNECTOR FOR FLAT CABLE

BACKGROUND OF THE INVENTION

Flat cables comprising a plurality of parallel spaced apart electric conductors enclosed between sheets of insulation are used in many electrical devices. The flat cables typically are used to join one array of electronic components to a related array of electronic components. Many times it also is necessary to join one flat cable to another.

The electrical connection of flat cables is effected by mechanically mounting an electrical connector to each conductor in the flat cable. One end of the connector may define a socket or plug which can be joined to an electronic component or to another connector. The opposite end of the prior art connector includes a metallic barb which is adapted to pierce through the insulator of the flat cable and into one of the conductors therein. The barb of the prior art connector then is bent over a portion of the flat cable to provide a mechanical connection. Certain known connectors include pairs of offset barbs which pierce through the insulation and through the conductor and are crimped into overlapping relationship in much the same way as the arms on a staple. A non-conductive housing often is placed over at least a portion of the connector and cable.

The known flat cable connectors have been difficult to properly mount on the cable. More particularly, the prior art connectors were individually mounted to the appropriate conductor in the flat cable. This mounting required proper longitudinal and lateral positioning of each connector with respect to its corresponding conductor. The prior art connectors that include spaced apart barbs which fold toward one another, as with a staple, requires extremely accurate lateral alignment. Specifically even a small degree of lateral misalignment could cause one barb in each pair to miss its corresponding conductor, thereby affecting the quality of the electrical connection. The various longitudinal and lateral alignments required for each connector on the flat cable necessitated the use of extremely precise equipment to mount the connectors on the flat cable. Additionally, a significant amount of quality control checking has been required to insure proper mounting.

The prior connectors for flat cables also typically use complex insulating housings. Generally one type of housing was used for plugs while another type was used for sockets.

In view of the above it is an object of the subject invention to provide connectors for flat cables that can be easily and accurately mounted to the cable.

It is another object of the subject invention to provide connectors for flat cables that are substantially self aligning.

It is an additional object of the subject invention to provide connectors for flat cables that enable a plurality of connectors to be mounted simultaneously.

It is a further object of the subject invention to provide connectors for flat cables that facilitate the proper lateral alignment of the connectors with respect to the conductors in the flat cable.

It is still another object of the subject invention to provide connectors for flat cables wherein plugs and sockets are mounted in an identical manner.

It is still an additional object of the subject invention to provide connectors and insulating housings for flat cables wherein both plugs and sockets are adaptable to the same housings.

SUMMARY OF THE INVENTION

The subject invention is directed to flat cable connectors uniquely designed to be securely, easily and accurately connected to the individual conductors of a flat cable. Each connector of the subject invention defines an elongated metallic member having opposed contact and cable mounting ends. A plurality of such connectors are initially joined to a carrier strip adjacent the cable mounting ends thereof, such that the plurality of connectors are aligned generally parallel to one another.

The cable mounting end of each connector includes an elongated generally planar support portion for mounting against a portion of the flat cable insulation. The support portion extends from the carrier strip to a longitudinal alignment lance which extends upwardly from the plane of the support portion. Preferably the alignment lance includes a generally upstanding stop portion aligned approximately orthogonally to the support portion, and an angled portion which is rotated toward the carrier strip at an angle to the support portion. In use, the alignment lance defines the proper longitudinal position of the connector with respect to the flat cable. More particularly, the flat cable and an array of connectors mounted to a carrier strip are moved axially toward one another until the end of the flat cable contacts the longitudinal alignment lance. As a result, the precise longitudinal alignment of the cable and the connector is greatly simplified.

The cable mounting end of each connector further includes a plurality of upwardly extending barbs disposed intermediate the alignment lance and the carrier strip. Each barb includes an upwardly extending point adapted to pierce the flat cable. Preferably, each barb is a planar structure which extends generally perpendicular to the planar support portion of the cable mounting end. Furthermore, the plane of each barb is aligned parallel to the longitudinal axis of the connector. In the preferred embodiment, each connector includes three spaced apart barbs each having one of its planar surfaces adjacent the longitudinal axis of the connector. However, alternate barbs are disposed on opposite sides of the longitudinal axis. Consequently the points at which adjacent barbs contact a conductor in a flat cable are slightly offset from one another with respect to the axis of the conductor, thereby minimizing lines of stress in the cable.

The spacing between adjacent connectors on a carrier strip is equal to the spacing between conductors in a flat cable. As a result, a plurality of the subject connectors can be mounted simultaneously to a flat cable. More particularly, the flat cable is laterally positioned with respect to the connectors such that the respective conductors are in line with the connectors on the carrier strip. The flat cable then is advanced longitudinally until the end thereof contacts the longitudinal alignment lances of the connectors. At this point, all of the connectors in an array are at the precise desired longitudinal position with respect to the flat cable. The connectors and the flat cable then are urged toward one another by appropriate dies such that the barbs pierce through the insulation and the respective conductor to extend through the opposed side of the flat cable. As noted above, each barb is adjacent to the longitudinal axis of its respective connector. Consequently, all of the barbs on each connector are virtually assured of making proper electrical contact with the respective conductor. After the barbs have passed entirely through the cable, they are folded over into secure contact with the cable by the dies. Alternate barbs are bent in opposite directions to provide a secure mechanical mounting.

An array of the above described connectors are securely mounted to the various conductors in a flat cable. After the connectors in the array are mounted, the carrier strip has completed its function of assuring proper spacing and alignment of the various connectors in the array. Consequently the carrier strip is removed after the individual connectors are securely mounted to the cable.

As noted above, the cable mounting end of each connector is identical regardless of the configuration of the contact end thereof. The contact end, however, can assume several different configurations depending upon the ultimate intended use. In several embodiments the contact ends are provided with a downwardly extending spring locking lance adapted to lockingly engage a window in an insulating housing as explained further below. Additionally, the contact end of all connectors is provided with a plurality of upwardly extending brackets to properly guide and support the connector in the housing.

Certain of the connectors function as sockets. On these connectors, the brackets which guide the connector into its insulating housing also function as electrical contacts for an associated plug connector. Additionally, the socket member includes an upwardly extending spring contact finger disposed generally centrally along the longitudinal axis of the connector and between the brackets thereof. The upwardly extending spring contact finger provides the desired electrical contact with an associated plug as explained herein.

Connectors which function as plugs include a contact portion which is longer than the contact portion of the socket connector. More particularly, the plug connector includes an elongated plug of generally U-shaped configuration and adapted to fit intermediate the brackets of the socket connector as well as into other standard sockets. The base of the U-shaped plug member defines a plane parallel to but spaced from the plane of the support portion at the cable mounting end of the connector. This relative displacement enables the plug to be slidably inserted into an associated socket, while maintaining the respective support portion of the plug and socket connectors in substantially a common plane. In this interconnected condition, the spring contact finger of the socket will be biased against the plug, thereby insuring secure electrical contact.

The flat cable connector assembly of the subject invention further includes a housing assembly which is mountable onto the flat cable and the connectors affixed thereto. The housing assembly comprises a plurality of separable generally rectangular housing units. Preferably one or more individual housing units can be severed from the entire assembly thereby forming a housing assembly in accordance with the number of conductors in a particular flat cable.

Each housing unit in a housing assembly includes a generally rectangular channel extending therethrough. The rectangular channel includes opposed front and rear ends. The entrance to the rear end of each rectangular channel is dimensioned to receive the portion of a connector having the brackets extending therefrom. The front end of the housing, however, will enable the passage of the plug therethrough, but will not permit the passage of the brackets. Each housing further includes a window dimensioned and aligned to receive the locking lance on both the plug and socket connectors. Thus, the locking lance of each connector will lockingly engage the window of the housing upon sufficient insertion of the connector into the housing. On a socket connector, the front end of the connector will be substantially adjacent the front end of the housing when the locking lance engages the window. On a plug connector, the plug portion thereof will extend entirely through the front end of the housing when the locking lance engages the window. Each housing further includes a pair of longitudinal slits extending from the rear end thereof toward the front end to enable a proper engagement of the flat cable.

DETAILED DESCRIPTION OF THE PREFERRED EMBODIMENTS

Figure 1:
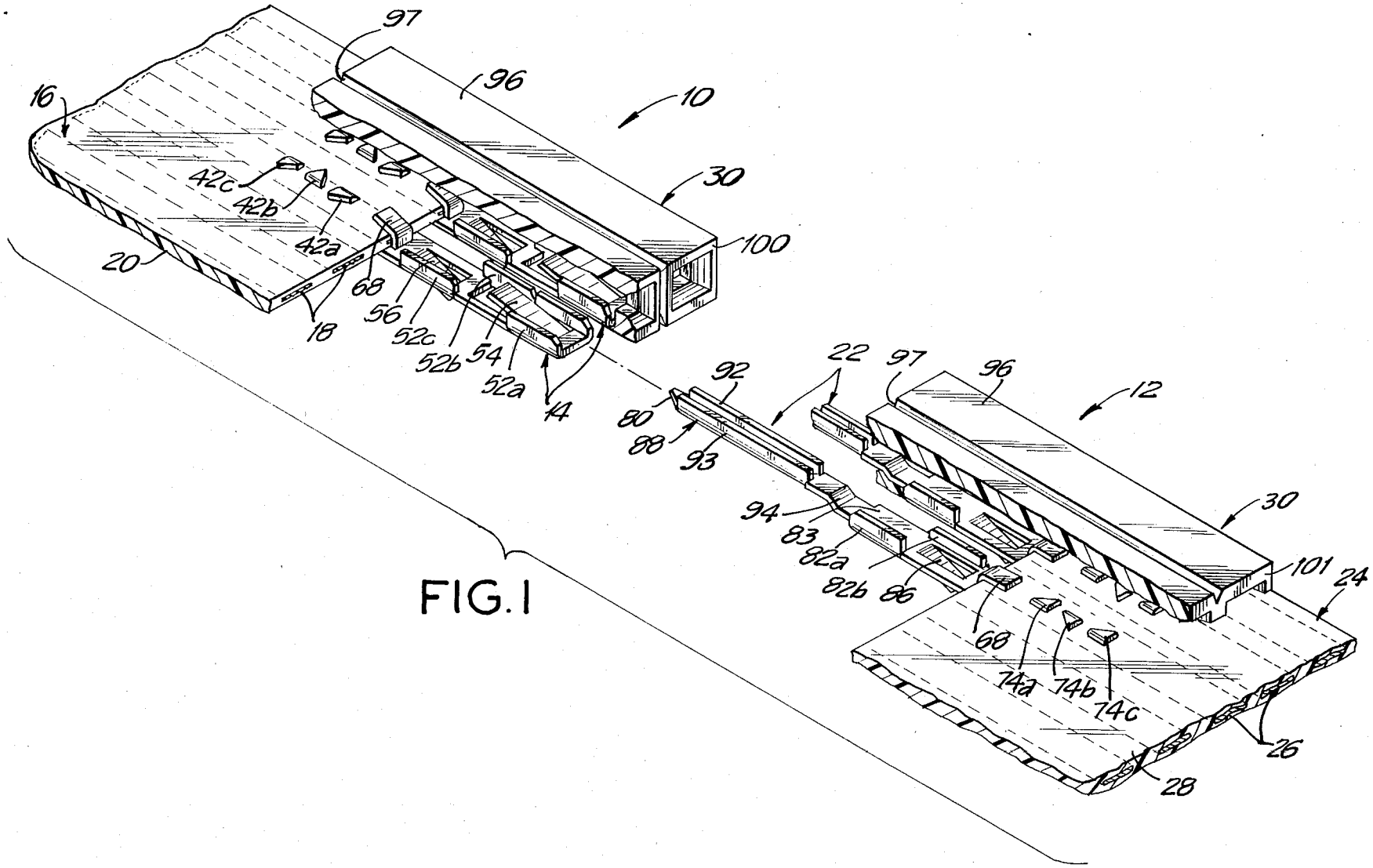
FIG. 1 is an exploded perspective view, partly in section of a pair of conenctors according to the subject invention.

The flat cable connector assembly of the subject invention may take the form of either a flat cable socket assembly indicated generally by the numeral 10 in FIG. 1, or a flat cable plug assembly, indicated generally by the numeral 12 in FIG. 1. The flat cable socket assembly 10 includes a plurality of substantially identical crimp-on socket connectors 14 which are mounted to a flat cable 16. The flat cable 16 is of generally standard construction with a plurality of parallel conductors 18 embedded in a generally flat insulation 20. As explained in greater detail below, each crimp-on socket connector 14 is constructed to make electrical contact with one conductor 18 in the flat cable 16, while simultaneously insuring a secure mechanical connection to the insulation 20 of flat cable 16.

Figure 2:
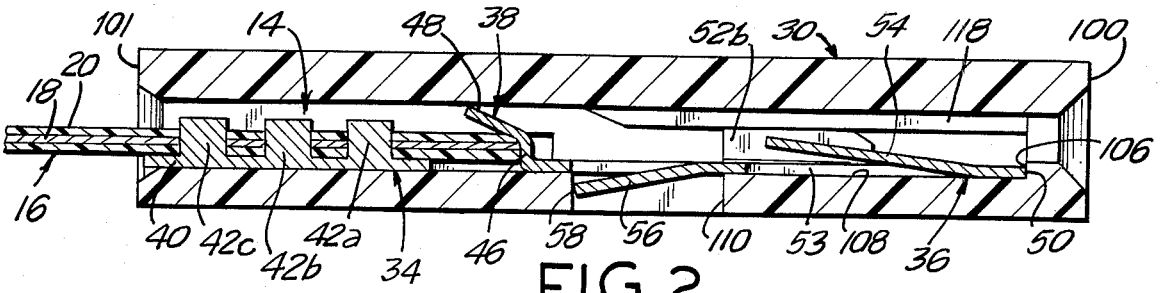
FIG. 2 is a cross-sectional view of a socket connector and housing according to the subject invention.

The flat cable plug assembly 12 includes a plurality of substantially identical crimp-on plug connectors 22 which are mounted to a standard flat cable 24 having parallel conductors 26 embedded in insulation 28. The socket and plug assemblies 10 and 12 each include an insulating housing structure 30 which are constructed to receive either an array of crimp-on socket connectors 14 or an array of crimp-on plug connectors 22 as illustrated generally in FIGS. 2 and 3 respectively and as described in detail below. The socket and plug assemblies 10 and 12 enable the connection of a flat cable 16 or 24 to either an appropriate electric component (not shown) or to one another, as illustrated in FIG. 1.

Figure 4:
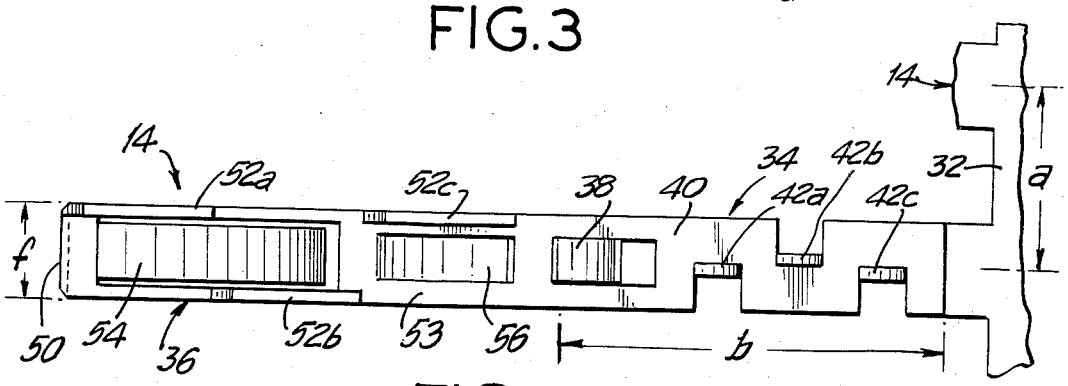
FIG. 4 is top plan view of a socket connector of the subject invention.
Figure 5:
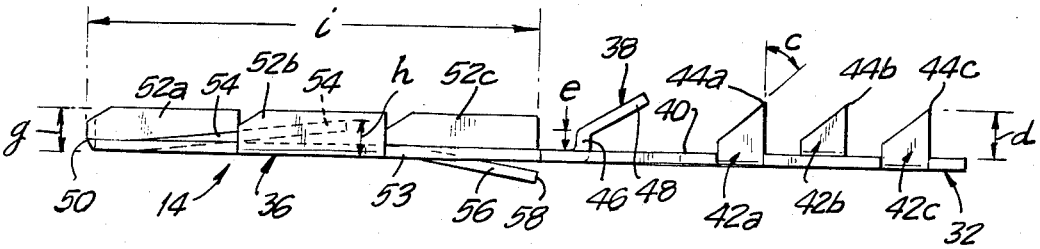
FIG. 5 is a side elevational view of a socket connector shown in FIG. 4.

Turning to FIGS. 4 and 5, the crimp-on socket connector 14 is formed from a single piece of conductive metal and preferably beryllium copper. A plurality of crimp-on socket connectors 14 are integrally joined to and equally spaced along a carrier strip 32. The socket connectors 14 are at 0.100 inch centers along carrier strip 32, as indicated by dimension "a" in FIG. 4. This spacing corresponds to the industry standard for spacing of conductors in flat cables. As explained in detail below, the carrier strip 32 is perpendicular to the connector 14 and facilitates the initial spacing and lateral alignment of crimp-on socket connectors 14 relative to one another and relative to the flat cable 16. Consequently, the crimp-on socket connector 14 remain attached to their respective carrier strip 32 until after mounting on the flat cable 16.

The crimp-on socket connector 14 includes opposed cable mounting and contact ends 34 and 36 respectively. The cable mounting end 34 is of generally elongated rectangular configuration and extends perpendicularly from the carrier strip 32 to generally upstanding longitudinal alignment lance 38. The distance between the carrier strip 32 and the alignment lance 38 is indicated by dimension "b" in FIG. 4 and is equal to approximately 0.25 inches. The distance "b" is sufficient to provide the desired mechanical and electrical connection between cable 16 and socket connector 14. The cable mounting end 34 includes a generally planar support portion 40 from which planar barbs 42*a*, 42*b* and 42*c* extend orthogonally. The barbs 42*a–c* are spaced from one another and are formed such that one planar surface of each barb 42*a–c* is adjacent the longitudinal axis of connector 14. However, alternate barbs are disposed on opposite sides of the longitudinal axis of the connector 14, such that barbs 42*a* and 42*c* are substantially in a common plane, but such that barb 42*b* lies in a different but generally adajcent plane. As illustrated most clearly in FIG. 5, each barb 42*a–c* includes a point 44*a–c* respectively defined by intersecting edges meeting at an angle "c" of approximately 38°. Preferably the points 44*a–c* each have a radius of no more than 0.005 inches to enable the barbs 42*a–c* to readily penetrate both the insulation 20 and the conductors 18 of flat cable 16. Furthermore, each barb 42*a–c* extends upwardly from the plane of support portion 40 a distance "d" of approximately 0.04 inches to enable the barbs 42*a–c* to be crimped over into secure mechanical connection with the flat cable 16 as explained below.

The longitudinal alignment lance 38 includes stop portion 46 and angled portion 48. The stop portion 46 extends orthogonally upward from the plane of support portion 40 a distance "e" of approximately 0.01 inches. The stop portion 46 defines the portion of each connector 14 against which the end of flat cable 24 is positioned, and its height "e" is approximately equal to the thickness of flat cable 16. As noted above, a plurality of connectors 14 would be mounted simultaneously to a flat cable 24 while still in contact with their respective carrier strip 32. This mounting is accomplished by advancing the connectors 14 and the flat cable 16 toward one another such that the end of the flat cable 16 simultaneously contacts the stop portions 46 of the longitudinal alignment lances 38 on each of the connectors 14. Thus, the proper longitudinal position of each connector 14 is assured.

The angled portion 48 of alignment lance 38 effectively guides the end of the flat cable 16 toward the stop portion 46 and prevents the flat cable 16 from flying over alignment lance 38. After the flat cable 16 has been properly positioned against the stop portion 46, the points 44*a–c* of barbs 42*a–c* are urged entirely through the flat cable 16. More particularly, the connector 14 and cable 16 are laterally aligned such that all three barbs 42*a–c* of a single connector 14 extend through a common conductor 18 of flat cable 16. Since the barbs 42*a–c* all are adjacent the longitudinal axis of the connector 14, a proper electrical contact is virtually assured. Stated differently, the relatively close lateral positioning of all barbs 42*a–c* relative to one another assures that all three barbs 42*a–c* will pierce the appropriate conductor 26 even if their is a slight lateral misalignment. After the barbs 42*a–c* have completely pierced through cable 24 the barbs 42*a–c* are alternately crimped over into secure mechanical connection with the flat cable 24, such that barbs 42*a* and 42*c* are bent in one direction, while barb 42*b* is bent in the opposite direction. The angled portion 48 of alignment lance 38 also is bent into engagement with cable 16. The piercing of cable 16 and the crimping of barbs 42*a–c* and alignment lance 38 is carried out with an appropriate die.

The contact end 36 of the crimp-on socket connector 14 extends essentially from lance 38 to end 50 of connector 14. The contact end 36 includes upstanding brackets 52*a*, 52*b*, and 52*c* which are alternately disposed on opposite sides of connector 14 and extend upwardly from base 53. The outside spacing between opposed brackets 52*b* and 52*a* or 52*c*, as indicated by dimension "f" is approximately 0.06 inches, which, as explained further below, enables the connector 14 to be slideably inserted into the housing 30. The dimension between the inner surfaces of opposed brackets 52*b* and 52*a* or 52*c* is greater than the standard 0.025 inch square electrical plugs as explained herein. The height of each brackets 52*a–c* as indicated by dimension "g" is approximately 0.030 inches.

Spring finger 54 extends upwardly from the plane of connector 14 and intermediate the brackets 52*a* and 52*b* to a maximum height "h" of 0.025 inches as measured from the bottom surface of connector 14. The spring finger 54 contributes to the electrical and mechanical connection between the crimp-on socket connector 14 and associated plug. More particularly, the spring finger 54 will be biased by a plug inserted into socket connector 14, and will thereby urge the plug into contact with the opposed wall of the housing 30 as explained below.

Locking lance 56 extends downwardly from connector 14 at a location substantially in line with the bracket 52*c*. More particularly, the end 58 of locking lance 56 is spaced from end of connector 14 a distance of approximately 0.30 inches as indicated by dimension "i" in FIG. 5. The locking lance 56 is angled such that the end 58 is spaced approximately 0.015 inches below the bottom of connector 14.

Figure 6:
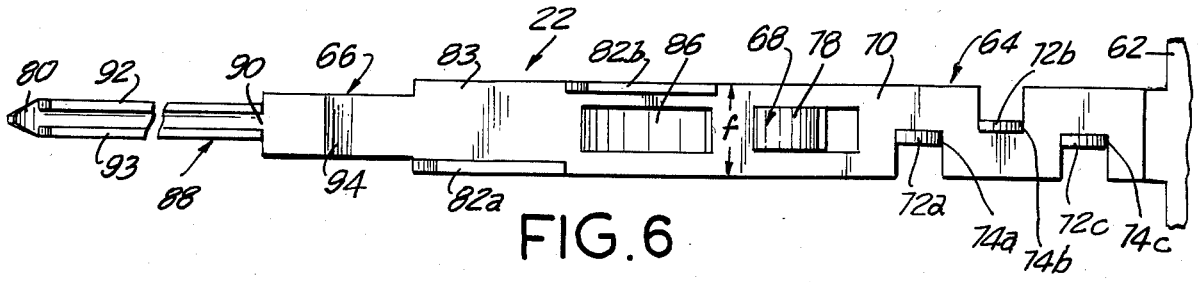
FIG. 6 is a top plan view of a plug connector of the subject invention.
Figure 7:
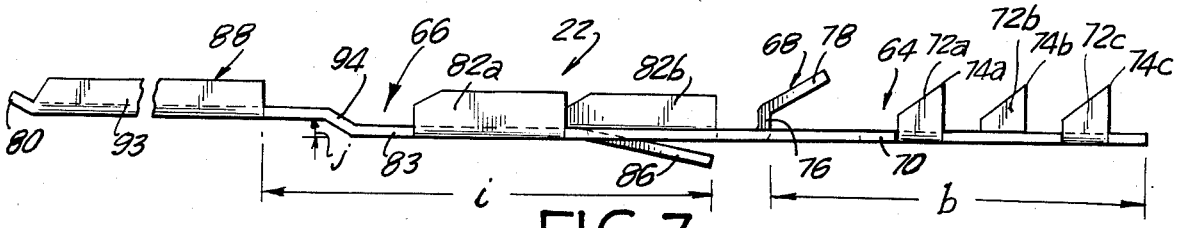
FIG. 7 is a side elevational view of the plug connector shown in FIG. 6.

Turning to FIGS. 6 and 7, the crimp-on plug connector 22 also is formed from a single piece of beryllium copper and is shown connected to a carrier strip 62 in substantially the identical manner as the socket connector 14 described above. The plug connector 22 includes opposed cable mounting and contact ends 64 and 66 respectively. The cable mounting end 64 of plug connector 22 extends from the carrier strip 62 to the longitudinal alignment lance 68. Barbs 72*a–c* are disposed intermediate lance 68 and carrier strip 62 in substantially the same manner as barbs 42*a–c* on the socket connector 14. More particularly, the barbs 72*a–c* are spaced from one another adjacent the longitudinal axis of plug connector 22, but are disposed alternately on opposite sides of the longitudinal axis. Barbs 72*a–c* are provided with points 74*a–c* which are adapted to penetrate through both the insulation 28 and the conductor 26 of flat cable 24 under the action of a die. The barbs 72*a–c* then are crimped in opposite directions to achieve secure electrical and mechanical contact.

As illustrated most clearly in FIG. 7, the alignment lance 68 is substantially identical to the alignment lance 38 described above, and includes an upstanding stop portion 76 and an angled portion 78. The cable mounting ends 64 and 34 respectively of the plug and socket connectors 22 and 14 are identical to one another. More particularly, the dimension and spacings of barbs 72*a–c* are substantially identical to the comparible dimensions of barbs 42*a–c*. Similarly, the distance between the stop portion 76 of alignment lance 68 and the carrier strip 62, as indicated by dimension "b" in FIG. 7 is substantially equal to the comparible distance on the socket connector 14 as indicated in FIG. 4. Preferably, dimension "b" is equal to 0.250 inches.

The contact end 66 of plug connector 22 extends from alignment lance 68 to the end 80 opposite carrier strip 62. The contact end 66 is further characterized by brackets 82*a* and 82*b* which extend upwardly from base 83 along opposite sides of connector 22, and are spaced from one another along the lengths of connector 22. The external distance between the brackets 82*a* and 82*b*, as indicated by dimension "f" in FIG. 6, is substantially equal to the comparible dimension "f" on the socket connector 14 as illustrated in FIG. 4. The brackets 82*a–b* function to guide and hold the connector 22 in the housing 30 as explained below.

Plug connector 22 further includes locking lance 86 which is substantially identical to the locking lance 56 on the socket connector 14. As explained further below, the locking lance 86 is longitudinally positioned to lockingly engage a window in the housing 30.

The plug connector 22 further includes a U-shaped plug 88. The plug 88 includes a bottom wall 90 and a pair of upstanding side walls 92 and 93 defining a square cross-section of approximately 0.025 inches in accordance with the industry standard. Angled wall member 94 is disposed intermediate the plug 88 and the brackets 82*a–b* such that the bottom wall 90 of plug 88 is parallel to but offset from the base 83 of contact end 66 by approximately 0.01 inches as indicated by dimension "j" in FIG. 7. The distance between the U-shaped plug 88 and the end of locking lance 86 is indicated by dimension "h" in FIG. 7 and is substantially equal to the distance "h" on the socket connector 14 as illustrated in FIG. 5. These identical dimensions enable the socket and plug connectors 14 and 22 to be used with identical housings 30 as described below. The connector end 66 of the plug connector 22 terminates in upwardly angled end 80 as shown in FIG. 7. The upward angle of end 80 and the U-shaped construction of plug 88 contribute to the strength of the plug connector 22.

Figure 8:
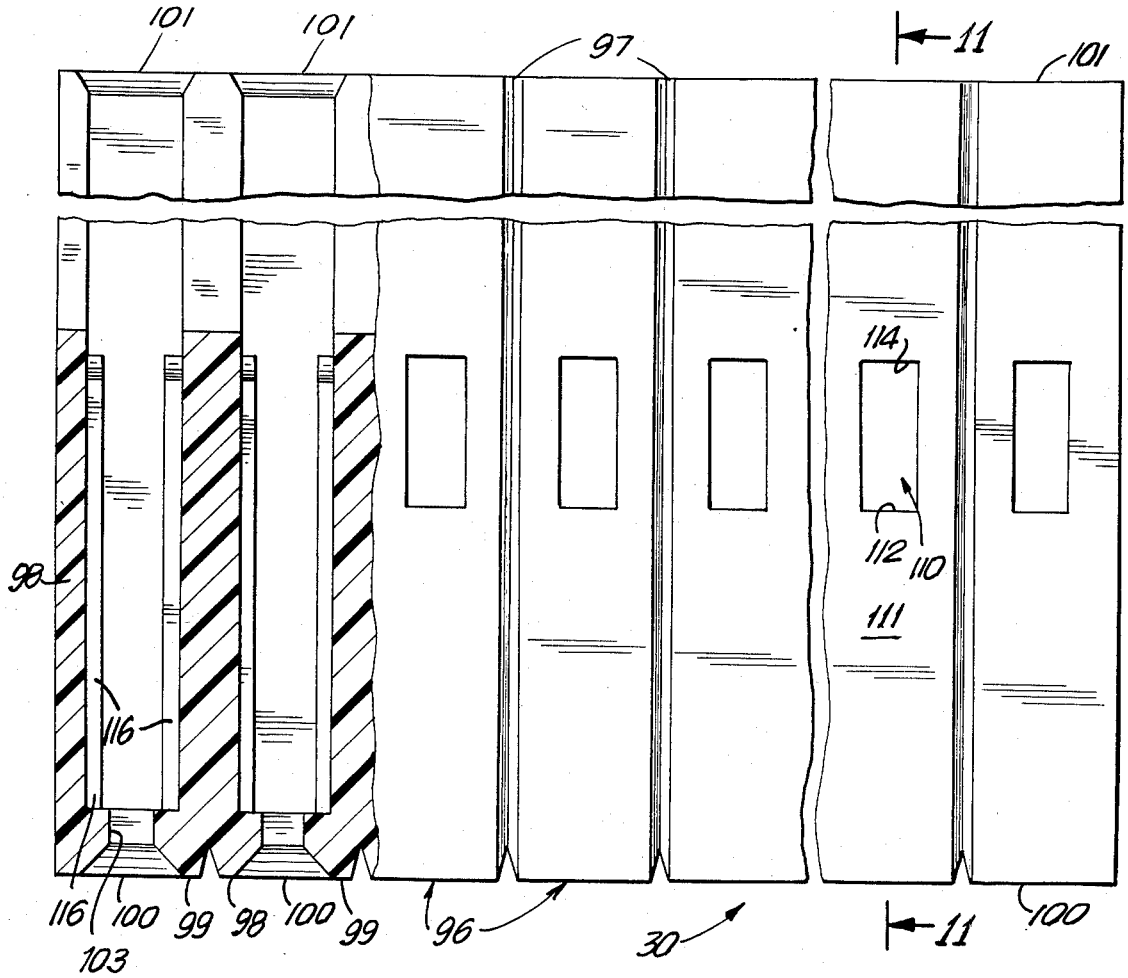
FIG. 8 is a bottom plan view of the housing assembly of the subject invention.
Figure 9:
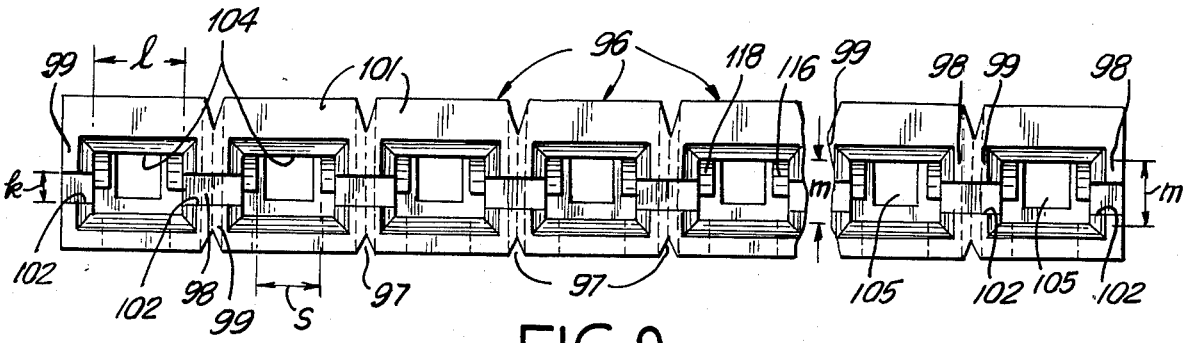
FIG. 9 is a rear elevational view of the housing assembly shown in FIG. 7.
Figure 10:
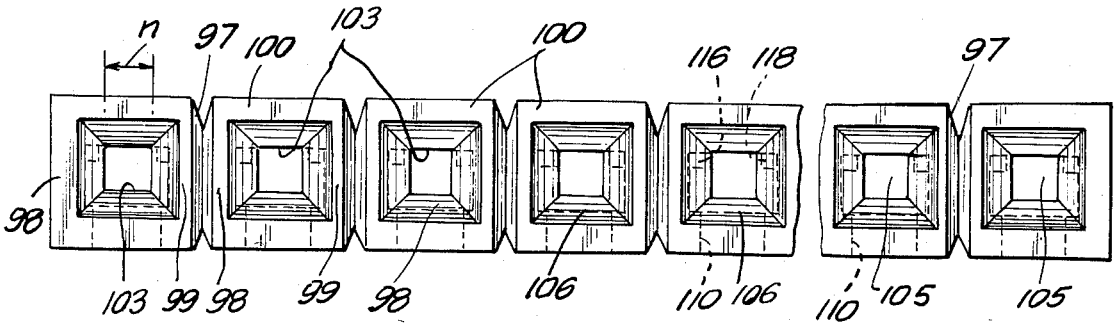
FIG. 10 is a front elevational view of the housing assembly shown in FIG. 7.

The housing structure 30 is illustrated in FIGS. 8 through 11. More particularly, as shown in FIGS. 8–10, the housing structure 30 includes a plurality of housing units 96 each of which is adapted to receive either a socket connector 14 or plug connector 22. The housing structure 30 may be broken along any of connections 97 between adjacent side walls 98 and 99 to define a housing structure 30 with the required number of units 96.

Each housing unit 96 includes opposed front and rear ends 100 and 101 respectively, and a generally rectangular passageway 105 extending therebetween. The front end 100 of each housing unit 96 defines the end thereof opposite the associated cable 16 or 24. More particularly, the front end 100 is the portion of each housing unit 96 through which an appropriate plug is inserted. The rear end 101 is adapted to receive an entire socket or plug connector 14 or 22 and a portion of the associated flat cable 16 or 24. More particularly, each housing unit 96 includes a slot 102 which extends into the associated housing unit 96 from the rear end 101. As shown best in FIG. 9 each slot 102 extends entirely across the appropriate housing unit 96 through the side walls 98 and 99. The slots 102 have a width of 0.02 inches as indicated by dimension "k" in FIG. 9, such that the flat cable 16 or 24 may be slideably inserted partway into an array of housing units 96. Each housing unit 96 further includes a rear opening 104 having a width "l" of approximately 0.064 inches and a height "m" of approximately 0.040 inches. The width and height "l" and "m" of each rear opening 104 is sufficient to accept either a socket connector 14 or a plug connector 22 upon at least partial compression of the appropriate locking lance 56 or 86 respectively.

Figure 11:
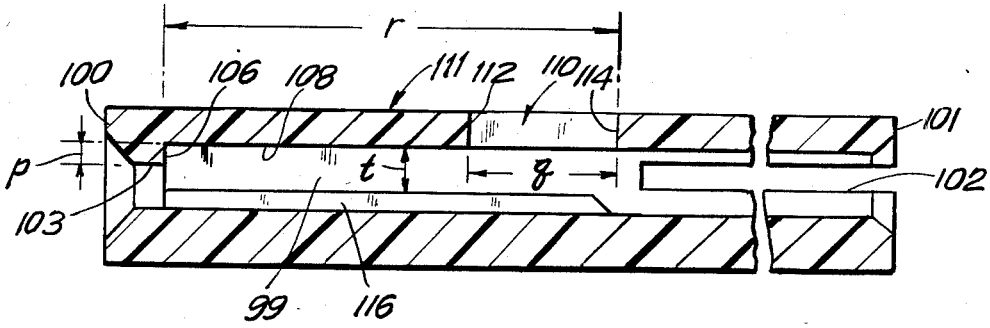
FIG. 11 is a cross-sectional view of the housing assembly shown in FIG. 7.

The front end 100 of each housing unit 96 includes a front opening 103 as illustrated in FIGS. 10 and 11. The front opening 103 has a width and height indicated by dimension "n" of approximately 0.030 inches. The dimensions of this square opening enable any standard 0.025 inch square plug, including the U-shaped plug 88 of connector 22 to be passed entirely therethrough. The front end 100 further is provided with a lower lip 106 which extends upwardly from the internal bottom surface 108 a distance "p" of approximately 0.010 inches. The lip 106 prevents the socket connector 14 from passing too far into the housing unit 96 and further insures that the bottom surface 90 of the U-shaped channel 88 on plug connector 22 will be properly aligned with the front opening 104. It is important to note that when the socket connector 14 is in the housing unit 96, the spring finger 54 will extend above the level of lip 106.

Each housing unit 96 further is provided with a locking window 110 formed in the bottom wall 111 thereof. The locking window 110 of each housing unit 96 is defined by opposed front and rear edges 112 and 114 respectively. The distance between front and rear edges 112 and 114 is approximately 0.100 inches as indicated by dimension "q" in FIG. 11. Furthermore, the distance between lip 106 and rear edge 114 is approximately 0.305 inches as indicated by dimension "r" in FIG. 11. These relative dimensions enable a locking lance 56 or 86 on either a socket or a plug connector 14 or 22 to be lockingly engaged into window 110.

Each housing unit 96 further includes a pair of opposed spaced apart longitudinally extending ribs 116 and 118. The ribs are spaced a distance "s", as shown in FIG. 9, which is approximately equal to 0.040 inches. The spacing between the ribs 116 and 118 thus defines a path through which the U-shaped plug 88 may pass unimpeded. The ribs 116 and 118 are spaced from the bottom wall 108 of each housing 96 a distance "t" of approximately 0.031 inches. Thus, the brackets 52*a–c* or 82*a–b* will be firmly held in place between the ribs 116 or 118 and the opposed internal bottom surface 108 of the housing unit 96.

Figure 3:
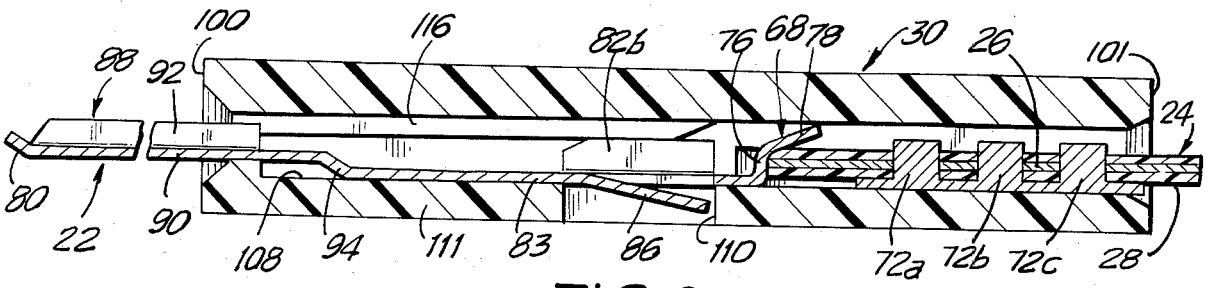
FIG. 3 is a cross-sectional view of a plug connector and housing according to the subject invention.

Returning to FIGS. 2 and 3, the socket and plug connectors 14 and 22 respectively are shown mounted in a housing unit 96. As illustrated therein, the appropriate cable 16, 24 is slidingly inserted into the slot 102 in housing unit 106. Upon complete insertion, the appropriate locking lance 56, 86 is lockingly engaged into the window 110 to prevent longitudinal movement of the socket 14, 22. Furthermore, the brackets 52*a–c* and 82*a–b* are securely retained between the internal bottom surface 108 and the ribs 116, 118. Additionally, as illustrated in FIG. 3, the bottom wall 90 of plug 88 is slid over the lip 106 enabling the entire U-shaped plug 88 to slide through the front opening 104.

Returning to FIG. 1, the entire socket assembly 10 can be used to join a flat cable 16 to a standard plug assembly or to the plug assembly 12. More particularly, with the plug assembly 12, the offset alignment of the U-shaped plug 88 enables the U-shaped plug to be properly inserted into an associated socket.

In summary, an improved crimp-on connector and housing is provided. Both the socket and plug connectors are provided with a cable mounting end including a plurality of barbs disposed adjacent to but alternately on opposite sides of the longitudinal axis of the connector. The cable mounting end further includes a longitudinal alignment lance for accurate longitudinally positioning of the cable and connectors relative to one another. Each connector is affixed to a carrying strip disposed adjacent the cable mounting end thereof. The carrier strip is maintained in contact with the connectors until the connectors are mounted to a flat cable. Thus, the carrier strip contributes to both the lateral and longitudinal alignment of the connectors relative to the cable. Each connector further includes a plurality of brackets and a locking lance for retaining the connector in a housing. The socket connectors are further provided with an upwardly extending spring finger to insure contact between a plug and the socket connector. The plug connector includes an elongated U-shaped plug offset from the plane of the cable mounting portion to facilitate proper contact between the spring finger and the plug. The housing is adapted to receive either an array of socket connectors or an array of plug connectors. Each housing is formed from a plurality of substantially identical and separable housing units. Each housing unit is adapted to receive both a connector and a portion of the associated flat cable. The housing units also include windows for lockingly receiving the locking lance of the connectors. A pair of longitudinally extending ribs are provided to contact the brackets on the connectors, thereby minimizing movement of the connectors within the housing.

While the invention has been described relative to certain preferred embodiments, it is obvious that various modifications can be made therein without departing from the spirit of the invention as defined by the appended claims.

What is claimed is:

1. A crimp-on connector for a flat cable, said connector comprising opposed cable mounting and contact ends, said cable mounting end including an elongated generally planar support portion, a plurality of barbs extending generally perpendicular to said support portion and adjacent to the longitudinal axis thereof with alternate barbs being disposed on opposite sides of said longitudinal axis and a longitudinal alignment lance extending from said support portion intermediate said barbs and said contact end, whereby said longitudinal alignment lance enables a precise longitudinal positioning of the connector relative to the cable and whereby the barbs are operative to pierce through and mount on the cable.

2. A connector as in claim 1 wherein the contact end of said connector includes a longitudinally extending base and a plurality of brackets extending upwardly from opposed sides of said base, whereby said brackets are operative to align and retain said connector.

3. A connector as in claim 2 wherein said contact end includes a spring finger connected to and extending from said base intermediate opposed brackets thereon, whereby said spring finger enables electrical connection of said contact end to a plug.

4. A connector as in claim 2 wherein said contact end includes a longitudinally extending plug of generally U-shaped cross-section at the end of said connector most distant from said cable mounting end.

5. A connector as in claim 4 wherein the U-shaped plug includes a bottom wall and a pair of opposed upstanding side walls, said bottom wall of said plug being parallel to but offset from the base of said contact end.

6. A connector as in claim 4 wherein the cross-section of said plug is approximately square.

7. A connector as in claim 1 further including a carrier strip removably attached to said connector at the cable mounting end thereof.

8. A connector as in claim 7 wherein the carrier strip is perpendicular to the longitudinal axis of the cable mounting end.

9. An array of connectors for mounting on a flat cable having a plurality of parallel conductors with the respective spacing between adjacent conductors being equal across said flat cable, said array of connectors including a carrier strip and a plurality of spaced apart connectors detachably connected to said carrier strip and extending perpendicular thereto, the spacing between adjacent connectors on said carrier strip being substantially equal to the spacing between the conductors in the flat cable, each said connector in said array including elongated opposed cable mounting and contact ends, said cable mounting end being disposed adjacent the carrier strip and including a generally planar support portion, a longitudinal alignment lance extending upwardly from said support portion and a plurality of barbs disposed intermediate said longitudinal alignment lance and said carrier strip, said barbs being adapted to extend through the flat cable and one conductor therein, whereby the connectors in said array can be simultaneously longitudinally aligned with the flat cable by the longitudinal alignment lances thereof.

10. An array as in claim 9 wherein the contact end of each said connector defines a plug.

11. An array as in claim 9 wherein said barbs extend generally perpendicular to said support surface and are disposed such that each said barb is adjacent the longitudinal axis of said connector but with alternate ones of said barbs being disposed on opposite sides of said longitudinal axis.

12. An array as in claim 11 wherein the contact end of each said connector defines a socket.

13. An electrical connector assembly for mounting to at least one conductor of a flat cable, said assembly comprising:

at least one non-conductive housing unit having opposed top and bottom walls and opposed side walls defining an elongated generally rectangular passage extending entirely therethrough, said housing unit further including a window extending through the bottom wall; and at least one elongated connector formed from a single piece of metallic material and dimensioned to be slidably inserted in the passage of said housing, said connector including opposed cable mounting and contact ends, said cable mounting end including a generally planar support portion for mounting against the cable, a plurality of barbs extending generally perpendicularly from the support portion and adapted to extend through the conductor and engage the cable, and a longitudinal alignment lance extending out of the plane of said support portion and disposed intermediate said barbs and said contact end, said longitudinal alignment lance being adapted to engage the end of the cable, said contact end including a longitudinally extending base extending from said support portion of said cable mounting end, a locking lance connected to and extending angularly down from said base and dimensioned and located to engage the window when the connector is inserted in the housing and a plurality of brackets extending upwardly from opposed sides of said base, and dimensioned to engage at least the side and bottom walls of the housing.

14. An assembly as in claim 13 wherein said side walls are characterized by a slot extending from the rear end of said housing unit to a point intermediate said front and rear ends, said slot being dimensioned to receive the flat cable.

15. An assembly as in claim 13 further including a lip extending upwardly from the bottom wall of said housing unit adjacent the front end thereof.

16. An assembly as in claim 13 wherein said housing unit includes a pair of ribs disposed in said passage respectively adjacent to the connection of said top wall to the opposed side walls, said ribs being spaced from the bottom wall of said housing unit.

17. An assembly as in claim 16 wherein each said bracket is disposed adjacent one said side wall of said housing and extends substantially the entire distance between the bottom wall of said housing and one of said ribs.

18. An assembly as in claim 13 comprising a plurality of said connectors and said housing units.

19. An assembly as in claim 18 wherein the housing units are detachably joined to one another along adjacent side walls thereof.

* * * * *